United States Patent [19]

Vessella

[11] 4,199,929

[45] Apr. 29, 1980

[54] DEVICE FOR PNEUMATICALLY THREADING YARN FOR A DOUBLE TWIST SPINDLE

[75] Inventor: Patrick Vessella, Villeurbanne, France

[73] Assignee: Verdol S.A., Caluire, France

[21] Appl. No.: 926,063

[22] Filed: Jul. 17, 1978

[30] Foreign Application Priority Data

Jul. 20, 1977 [FR] France ..... 77 22839

[51] Int. Cl.[2] ..... D01H 7/86; D01H 13/10

[52] U.S. Cl. ..... 57/279; 57/58.7; 57/58.86

[58] Field of Search ..... 57/34 R, 34.5, 58.7, 57/58.87, 58.49, 106, 58.86, 279, 280

[56] References Cited

U.S. PATENT DOCUMENTS

| | | | |
|---|---|---|---|
| 1,962,265 | 6/1934 | Wenzel | 57/34.5 |
| 3,333,407 | 8/1967 | DeBruin et al. | 57/106 X |
| 3,482,387 | 12/1969 | Slack | 57/106 |
| 3,593,511 | 7/1971 | Guignard et al. | 57/280 |
| 3,822,539 | 7/1974 | Heap et al. | 57/34 R |
| 3,830,051 | 8/1974 | Veltges | 57/58.86 X |
| 3,936,997 | 2/1976 | Marzoli | 57/34 R X |
| 3,945,184 | 3/1976 | Franzen | 57/279 X |
| 3,975,893 | 8/1976 | Franzen | 57/58.7 X |
| 3,981,128 | 9/1976 | Munker | 57/58.7 X |
| 4,047,372 | 9/1977 | Horstmann et al. | 57/34 R |

FOREIGN PATENT DOCUMENTS 2309578 9/1974 Fed. Rep. of Germany .

*Primary Examiner*—John Petrakes
*Attorney, Agent, or Firm*—Dowell and Dowell

[57] ABSTRACT

A device for pneumatically threading yarn for a double twist spindle supporting at least one yarn brake, is characterized in that said device comprises a pneumatic system operative firstly to retract the normally applied yarn brake and then to achieve the automatic threading of the yarn through the shaft of the spindle, likewise in pneumatic manner.

8 Claims, 4 Drawing Figures

DEVICE FOR PNEUMATICALLY THREADING YARN FOR A DOUBLE TWIST SPINDLE

The present invention relates to improvements in systems allowing the pneumatic threading of a yarn in the bore of a double twist spindle and more particularly when this spindle is provided with a yarn brake.

It is known that the bore of a double twist spindle generally comprises at least one yarn brake when one or more independent yarns, previously wound on a bobbin, are to be twisted. Such a yarn brake is in fact indispensable for balancing the balloon tension of the double twist spindle. A plurality of yarn brakes may be used to avoid loops.

On the other hand, it is known automatically to thread one or more yarns in a spindle by means of a compressed air gun provided with an end piece adapted to cooperate with the upper end of the spindle in order to allow, after passage of the yarn transversely above this bore, a jet of compressed air to be sent, which conveys the yarn downwardly of the spindle from which it leaves radially and rises above the bobbin by cooperation with the inner face of a peripheral balloon limiter. The gun in question may obviously be mounted at the end of an oscillating arm which enables it to be positioned more easily.

However, such a device is unsuitable to allow threading of a yarn if the bore of the spindle comprises a conventional yarn brake.

The improvements according to the present invention allow such a device to be produced, of which the functioning is automatic.

According to the invention, the jet of air intended to take the yarn through the bore of the spindle is also intended to actuate means adapted to retract at least one yarn brake disposed in the spindle bore.

The invention will be more readily understood on reading the following description with reference to the accompanying drawings, in which.

Figure 1:
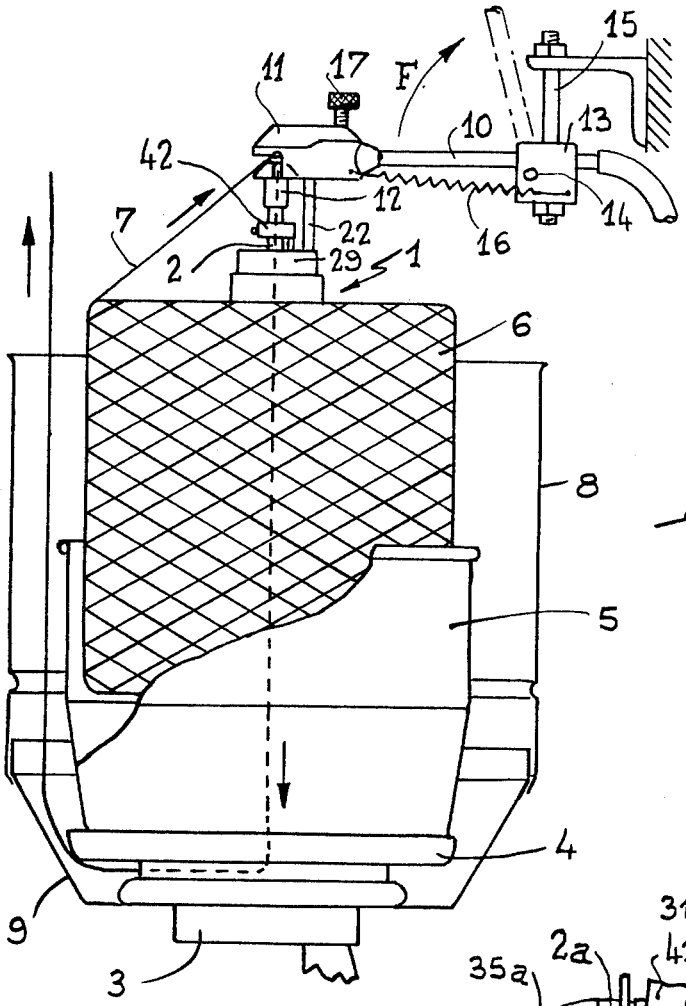
FIG. 1 is a schematic view showing a device according to the invention associated with a double twist spindle.

Referring now to the drawings, FIG. 1 shows the essential arrangement of a double twist spindle generally designated by reference 1 and which comprises a tubular shaft 2 whose lower end is fast with a fixed whorl 3. The shaft carries a plate 4 rotating therewith and above which is disposed a fixed can 5 receiving a bobbin 6.

The shaft 2 presents, at the level of plate 4, a side opening allowing the yarn 7 issuing from the bobbin 6 to leave this spindle and rise in known manner between the can 5 and a balloon limiter 8 made in the form of a sleeve supported by a base 9 of truncated form which is fixed to the whorl 3.

The problem to be solved consists in passing the yarn 7 in the bore of the shaft 2, avoiding a yarn brake disposed in the bore of this shaft.

To this end, it is provided to mount, at the end of an air inlet tube 10, a distributor head 11 adapted to cover a tubular end piece 12 disposed at the end of the shaft 2.

The other end of the tube 10 is associated with a bearing 13 which may pivot about a horizontal axis 14 with respect to a support 15 fixed to the frame of the machine. It will be noted that the head 11 is connected to the bearing 13 by means of a tension spring 16. In functioning position, the assembly 10–11 is retracted by pivoting it upwardly in the direction of arrow F.

Figures 2, 3:
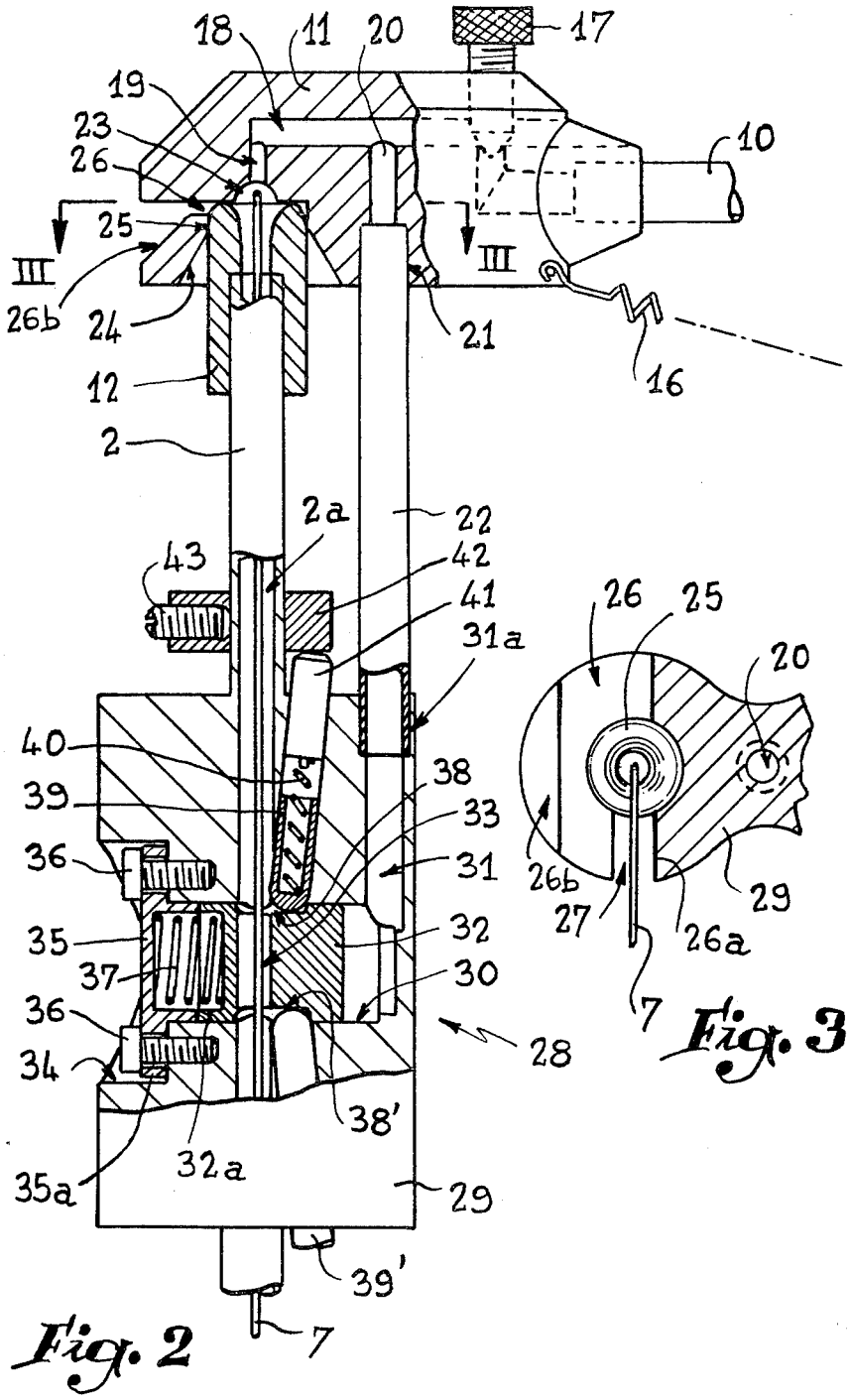
FIG. 2 shows, on a larger scale, the device according to the invention whilst the yarn is being threaded.
FIG. 3 is a section along III—III (FIG. 2).

As shown in FIG. 2, the head 11 is provided with a cock 17 adapted to allow the passage of the air of tube 10 in a hole 18 in which two channels 19, 20, oriented perpendicularly to hole 18, terminate, the diameter of the first channel 19 being very clearly smaller than that of the other 20. This latter is extended downwardly by a perforation 21 of larger diameter in which a pipe 22 is force-fitted. The channel 19 opens downwardly into a transverse groove 23 presenting, in section, a semi-circular form of reduced dimensions. The head 11 comprises in the same geometrical axis as the channel 19 a truncated opening 24 facing downwardly and which extends upwardly by a cylindrical bore 25. The head 11 further comprises a horizontal slot 26 whose depth is such that its inner edge 26*a* is hollowed by the bore 25 (FIG. 3). It is observed that the bottom of this bore is located at the level of the upper face of this slot in which face the groove 23 is made parallel to the inner edge 26*a* of the slot 26. It will be noted that the end outlet of the slot 26 is provided with a bevel 26*b*. In addition, the part of said head 11 which is located below the slot 26 comprises a notch 27 causing the bore 25 to communicate with the outside and preferably oriented parallel to the edge 26*a*. This opening is advantageously centred with respect to the channel 19.

The end piece 12 of the shaft 2 presents an outer diameter such that it may penetrate without notable clearance in the bore 25 after having passed through the truncated opening 24. In this position, the top of the end piece 12 is partially closed by the upper face of the slot 26, only the groove 23 of small dimensions causing the channel 19 to communicate with the outside.

Along shaft 2, it is provided to place a yarn brake device generally referenced at 28 at a suitable distance from the end piece 12. This device is disposed in a block 29 rendered fast with the shaft 2 by any suitable means. The block 29 is provided with a blind transverse bore 30 through which passes the hole 2*a* of the shaft 2 and in which opens a channel 31 parallel to said shaft and which terminates in a facing 31*a* whose diameter is such that the pipe 22 may engage freely therein.

In the bore 30 is placed a piston 32 comprising a transverse hole 33 disposed in line with the hole 2*a* of the shaft 2. There is arranged at the outlet of the bore 30 a facing 34 in which is fixed the peripheral flange 35*a* of a stopper 35 by means of screws 36. The stopper is tubular in shape, in which is engaged one of the ends of a compression spring 37, the other end of which is placed in a dish 32*a* made in the corresponding end of the piston 32. The periphery of this latter is provided with a longitudinal depression 38 in which abuts a yarn clamping system comprising a shoe 39 elastically pushed by one of the ends of a spring 40, the opposite end of which abuts on a pin 41, itself resting against a ring 42. This ring may be displaced along the shaft 2 with respect to which it is fixed by means of a press screw 43. The force of abutment of the shoe 39 against the depression 38 may thus be determined. In certain particular cases, and as indicated in FIG. 2, the piston 32 may comprise a second depression 38′ diametrically opposite 38 and cooperating with a second shoe 39′. It will be noted that the shoes are mounted in inclined manner with respect to the shaft 2 to effect a simple adjustment of the pressure of abutment of these shoes by means of the ring 42.

When it is desired to pass the yarn 7 issuing from the bobbin 6 in shaft 2, one begins by bringing the distributor head 11 so that it covers the end piece 12 and the pipe 22 comes in the facing 31*a*, by pivoting the whole about the axis 14 from its retracted position. It is understood that the spring being disposed obliquely it maintains the head in this position.

The free end of the yarn 7 is then taken and oriented parallel to the edge 26*a* of the slot 26 and is introduced thereinto. The passage of the yarn provokes a slight upward displacement of the head 11 when it passes between said latter and the end of the end piece 12 then this head returns into place when the yarn 7 arrives in the transverse groove 23. At this moment, the yarn projects on either side of the head and it is partially disposed above the bore of the shaft 2. The cock 17 is then actuated, which allows pressurised air arriving through tube 10 to penetrate in the hole 18 of the head 11.

The air then passes in the channel 20, then in the pipe 22 to arrive via channel 31 in the transverse bore 30 of the block 29. The pressure of the air against the end of the piston 32 which comprises the brake retracting means provokes the displacement of said latter towards the left in FIG. 2 against the reaction of the spring 37, so that the hole 33 comes into alignment with the bore 2*a* of the shaft 2 when the dish 32*a* comes against the stopper 35. Due to the presence of the shoe 39 cooperating with the longitudinal depression 38, the piston cannot rotate and the hole 33 is thus well in alignment with 2*a*.

As the diameter of the channel 20 is larger than that of the channel 19, the rate of flow of air is greater in the first, so that the displacement of the piston 32 is effected before the yarn is taken along by the air which passes through channel 19, so that it may therefore pass through the piston 32 without hindrance.

The synchronisation of the two operations is further facilitated by the leakage of air which is produced by groove 23.

Figure 4:
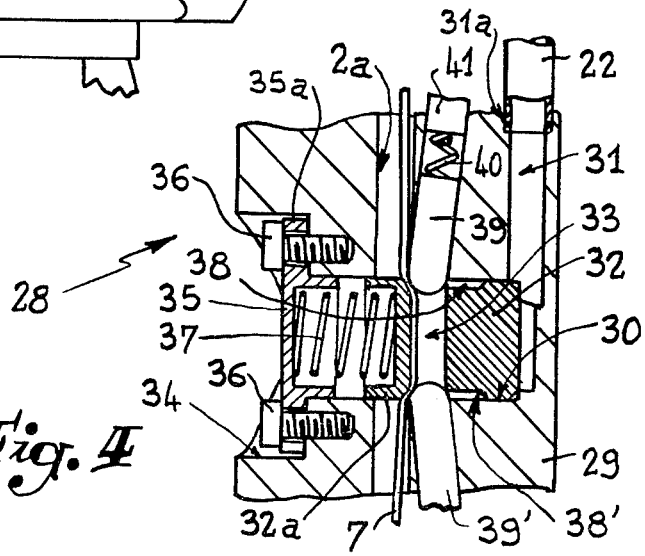
FIG. 4 illustrates the manner in which the yarn cooperates with a retractable yarn brake according to the invention.

When the free end of the yarn has risen above the balloon limiter 8, the user seizes it and releases the cock 17. The piston 32 no longer being actuated by the compressed air, the reaction of the spring 37 returns it against the bottom of the blind bore 30. The end of the shoe 39 then wedges the yarn against the inlet of the transverse hole 33 (FIG. 4) to brake the unwinding of this yarn during the subsequent operations. The braking pressure is regulated by displacing the ring 42 with a view to more or less compressing the spring 40. Of course, as has been indicated hereinabove, a second shoe 39′ may be provided, which doubles the braking effect by wedging the yarn at the level of the opposite outlet of the hole 33. Due to the presence of the notch 27, the head 11 may then be raised by tipping it in the direction of arrow F (FIG. 1) after having correctly oriented the strand of yarn before its entrance in the shaft (FIG. 3), i.e. parallel to the edge 26*a* of the slot 26 so that it passes through said notch 27.

What is claimed is:

1. A device for pneumatically threading yarn through the axial bore of a hollow shaft supporting a double twist spindle mechanism, wherein the shaft has a normally applied yarn brake located in its bore, comprising:
   - pneumatic retracting means connected to the yarn brake for retracting the brake and opening the bore;
   - pneumatic head means operative to pass air through the bore to jet the yarn therethrough; and
   - pneumatic distributing means connected with said retracting means and said head means and operative sequentially to first retract said yarn brake and thereafter to pass air through the bore of the shaft.

2. A device as claimed in claim 1, wherein said device includes a source of air under pressure, said distributing means comprising a first air channel connected between said source and said retracting means and a second air channel connected between said source and said head means, the second channel having a reduced diameter which is much smaller than the diameter of the first channel whereby pneumatic pressure is applied through the first channel to retract the yarn brake before air is passed through the second channel to jet the yarn through the bore.

3. A device as claimed in claim 2, wherein said shaft has a transverse bore crossing its axial bore, and the yarn brake comprises a piston in said transverse bore, the piston having a hole therethrough which aligns with the axial bore when the piston is in a retracted position, and spring urged clamping means clamping the yarn against the hole when the piston is in an unretracted position, said first air channel being connected to the transverse bore to apply air pressure against the piston and move it toward a retracted position.

4. A device as claimed in claim 3, wherein the yarn clamping means is located with respect to the piston such that when air pressure is applied to the transverse bore the piston is displaced therein such that the piston first disengages the hole from the yarn clamping means and then is further displaced until the hole in the piston aligns with the axial bore of the shaft.

5. A device as claimed in claim 4, further including means operative in the transverse bore to engage the piston and maintain its hole parallel with the axial bore.

6. A device as claimed in claim 5, wherein said yarn clamping means comprises a spring-urged elongated clamping element extending into said transverse bore, and said piston having an elongated depression receiving said clamping element and comprising therewith said guide means.

7. A device as claimed in claim 6, wherein said elongated element of said yarn clamping means includes a pin portion which extends along said shaft outside of its axial bore and a shoe portion which contacts said piston and a spring compressed therebetween, and a ring surrounding said shaft and adjustably fixed thereon, the ring abutting the pin portion and compressing the spring to determine the force of the shoe portion on the piston.

8. A device as claimed in claim 3, wherein the device further includes spring means in said transverse bore operative to urge the piston toward an unretracted position wherein the yarn clamping means is applied.

* * * * *